US009051622B2

(12) United States Patent
Arai et al.

(10) Patent No.: US 9,051,622 B2
(45) Date of Patent: Jun. 9, 2015

(54) NON-ORIENTED MAGNETIC STEEL SHEET AND METHOD FOR PRODUCING THE SAME

(75) Inventors: Satoshi Arai, Tokyo (JP); Yasuhide Morimoto, Tokyo (JP); Kiyokazu Ishizuka, Tokyo (JP); Kazutoshi Takeda, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 271 days.

(21) Appl. No.: 13/256,166

(22) PCT Filed: Mar. 9, 2010

(86) PCT No.: PCT/JP2010/053873

§ 371 (c)(1),
(2), (4) Date: Sep. 12, 2011

(87) PCT Pub. No.: WO2010/104067

PCT Pub. Date: Sep. 16, 2010

(65) Prior Publication Data

US 2012/0009436 A1 Jan. 12, 2012

(30) Foreign Application Priority Data

Mar. 13, 2009 (JP) ..... 2009-061918
Mar. 13, 2009 (JP) ..... 2009-061981

(51) Int. Cl.
*B21B 1/08* (2006.01)
*C21D 6/00* (2006.01)
(Continued)

(52) U.S. Cl.
CPC ..... *C21D 6/008* (2013.01); *Y10T 428/12458* (2015.01); *B21B 1/08* (2013.01);
(Continued)

(58) Field of Classification Search
CPC ..... B32B 5/14; B21B 1/08
USPC ..... 148/110–113, 307; 428/610
See application file for complete search history.

(56) References Cited

U.S. PATENT DOCUMENTS

2004/0149355 A1 8/2004 Kohno et al.
2008/0060728 A1 3/2008 Kohno et al.

FOREIGN PATENT DOCUMENTS

CN 1520464 A 8/2004
JP 61-201783 A 9/1986
(Continued)

OTHER PUBLICATIONS

English Machine Translation of JP401132718A, May 1989.*
(Continued)

*Primary Examiner* — Jie Yang
(74) *Attorney, Agent, or Firm* — Birch, Stewart, Kolasch & Birch, LLP

(57) ABSTRACT

A non-oriented magnetic steel sheet contains, by mass %, C: 0.005% or less; Si: 2% to 4%; Mn and V: totally 11% or less; and Al: 3% or less, with the balance being Fe and inevitable impurities, wherein a Mn concentration (mass %) and a V concentration (mass %) in a thickness direction satisfy the following formula. $0.1<(Xs_{Mn,V}-Xc_{Mn,V})/t_{Mn,V}<100$, where $Xs_{Mn,V}$: a sum of the Mn concentration (mass %) and the V concentration (mass %) at a surface of the steel sheet, $Xc_{Mn,V}$: a sum of the Mn concentration (mass %) and the V concentration (mass %) at a center of the steel sheet, and $t_{Mn,V}$: a depth (mm), from the surface of the steel sheet, of a position where the sum of the Mn concentration (mass %) and the V concentration (mass %) is equal to $Xc_{Mn,V}$.

8 Claims, 7 Drawing Sheets

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***H01F 1/16*** | (2006.01) |

(52) U.S. Cl.

CPC ..... *C21D 6/005* (2013.01); *C21D 8/1222* (2013.01); *C21D 8/1233* (2013.01); *C21D 8/1272* (2013.01); *C21D 8/1277* (2013.01); *C21D 8/1283* (2013.01); *C21D 2201/05* (2013.01); *C22C 38/004* (2013.01); *C22C 38/02* (2013.01); *C22C 38/04* (2013.01); *C22C 38/06* (2013.01); *C22C 38/12* (2013.01); *H01F 1/16* (2013.01)

(56) References Cited

FOREIGN PATENT DOCUMENTS

| | | | | |
|---|---|---|---|---|
| JP | 04191393 | A | * | 7/1992 |
| JP | 7-258863 | A | | 10/1995 |
| JP | 11-323511 | A | | 11/1999 |
| JP | 2005-240185 | A | | 9/2005 |
| JP | 2007-247047 | A | | 9/2007 |
| KR | 2000037999 | | * | 7/2000 |
| TW | 200422407 | | | 11/2004 |

OTHER PUBLICATIONS

NPL: abstract of JP-04191393 A, Jul. 1992.*

Forms PCT/IB/338, PCT/IB/373 and PCT/ISA/237, mailed Oct. 27, 2011, for International Application No. PCT/JP2010/053873.

Korean Office Action, dated Dec. 9, 2013, for Application No. 10-2011-7024043 with partial English language translation.

* cited by examiner

NON-ORIENTED MAGNETIC STEEL SHEET AND METHOD FOR PRODUCING THE SAME

TECHNICAL FIELD

The present invention relates to a non-oriented magnetic steel sheet suitable for a core of a motor and a method for producing the same.

BACKGROUND ART

In recent years, from the viewpoint of environmental protection, energy saving, and the like, there is an increasing interest in electric vehicles. Higher rotation speed and downsizing are required of driving motors of the electric vehicles, and accordingly, their driving frequency has become around 800 Hz.

When such a driving motor is in operation, high frequency components several times as high as the driving frequency is superimposed on the driving frequency. This gives rise to a demand that a non-oriented magnetic steel sheet being a core material of the driving motor should be excellent not only in mechanical property enabling the higher rotation speed and downsizing but also in magnetic property, especially, in core loss property, in a high-frequency range of 400 Hz to 2 kHz.

The core loss can be roughly classified into eddy-current loss and hysteresis loss. The eddy-current loss is proportional to the square of a thickness of the non-oriented magnetic steel sheet and is in inverse proportion to specific resistance. Therefore, in order to reduce the eddy-current loss, an attempt has been made to reduce the thickness of the non-oriented magnetic steel sheet. Another attempt has been made to increase a Si amount and/or an Al amount in the non-oriented magnetic steel sheet to increase the specific resistance. The increase in the Si amount and/or the Al amount can also increase mechanical strength (rotor rigidity).

However, related arts cannot fully reduce the core loss in the high-frequency range of, for example, 400 Hz to 2 kHz.

CITATION LIST

Patent Literature

Patent Literature 1: Japanese Laid-open Patent Publication No. 2007-247047

Patent Literature 2: Japanese Laid-open Patent Publication No. 07-258863

Patent Literature 3: Japanese Laid-open Patent Publication No. 11-323511

Patent Literature 4: Japanese Laid-open Patent Publication No. 2005-240185

SUMMARY OF THE INVENTION

Technical Problem

It is an object of the present invention to provide a non-oriented magnetic steel sheet whose core loss in a high-frequency range can be fully reduced and a method for producing the same.

Solution to Problem

The present inventors noticed that, with a high-frequency range of 400 Hz to 2 kHz, eddy-current flows only up to an about 50 μm depth from a surface of a steel sheet, and studiously studied an art to increase electric resistance in an area whose depth from the surface of the steel sheet is 50 μm.

As a result, the present inventors have found out that it is possible to reduce high-frequency core loss by plating the surface of the steel sheet with Mn or V, which makes a resistance increasing rate high, and diffusing Mn or V in the steel by annealing to form a gradient of a Mn concentration or a V concentration from the surface of the steel sheet to a prescribed depth.

The present invention was made based on the above findings, and its gist is as follows.

A non-oriented magnetic steel sheet according to the present invention contains, by mass %: C: 0.005% or less; Si: 2% to 4%; Mn and V: totally 11% or less; and Al: 3% or less, with the balance being Fe and inevitable impurities, wherein a Mn concentration (mass %) and a V concentration (mass %) in a thickness direction satisfy the following formula:

$$0.1<(Xs_{Mn,V}-Xc_{Mn,V})/t_{Mn,V}<100,$$

where $Xs_{Mn,V}$: a sum of the Mn concentration (mass %) and the V concentration (mass %) at a surface of the steel sheet, $Xc_{Mn,V}$: a sum of the Mn concentration (mass %) and the V concentration (mass %) at a center of the steel sheet, and $t_{Mn,V}$: a depth (mm), from the surface of the steel sheet, of a position where the sum of the Mn concentration (mass %) and the V concentration (mass %) is equal to $Xc_{Mn,V}$.

Advantageous Effects of Invention

According to the present invention, owing to the appropriate regulation of the Mn and V concentrations, it is possible to fully reduce core loss in a high-frequency range of, for example, 400 Hz to 2 kHz.

DESCRIPTION OF EMBODIMENTS (First Embodiment)

Figure 1A:
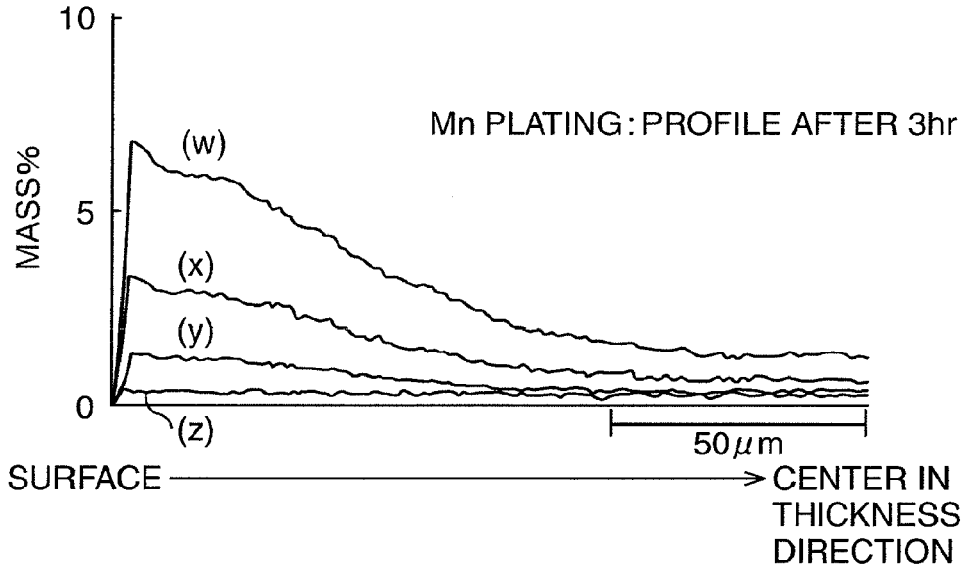
FIG. 1A is a chart showing correlations between a thickness of a Mn plating film and a distribution of a Mn concentration when 900° C. annealing is conducted for three hours.

A non-oriented magnetic steel sheet according to a first embodiment of the present invention contains, by mass %: C: 0.005% or less; Si: 2% to 4%; Mn: 10% or less; and Al: 3% or less, with the balance being Fe and inevitable impurities, wherein a Mn concentration (mass %) in a thickness direction satisfies the following formula (1) or the following formula (2):

$$0.1<(Xs_{Mn}-Xc_{Mn})/t_{Mn}<100 \quad (1)$$

$$0.1<(Xs_{Mn}'-Xc_{Mn})/t_{Mn}<100 \quad (2),$$

where $Xs_{Mn}$: the Mn concentration (mass %) at a surface of the steel sheet, $Xs_{Mn}'$: the maximum Mn concentration (mass %) near the surface of the steel sheet, $Xc_{Mn}$: the Mn concentration (mass %) at a center of the steel sheet, and $t_{Mn}$: a depth (mm), from the surface of the steel sheet, of a position where the Mn concentration (mass %) is equal to $Xc_{Mn}$.

To produce the non-oriented magnetic steel sheet according to the first embodiment, Mn plating is applied on a surface of a base steel sheet with a predetermined component composition so as to form a Mn plating film, and thereafter Mn is diffused in the steel by annealing. During the annealing, recrystallization of the base steel sheet also occurs. As the base steel sheet that is to be Mn-plated, used is, for example, a cold-rolled steel sheet obtained in such a manner that an annealed hot-rolled steel sheet is cold-rolled to a predetermined thickness (for example, a thickness of a product sheet). In this case, a Mn-plated cold-rolled steel sheet is obtained by the Mn plating, and thereafter, the Mn-plated cold-rolled steel sheet is annealed. Alternatively, an annealed hot-rolled steel sheet may be used as the base steel sheet. In this case, a Mn-plated hot-rolled steel sheet is obtained by the Mn plating, and thereafter a Mn-plated cold-rolled steel sheet is obtained by cold rolling of the Mn-plated hot-rolled steel sheet. Then, the Mn-plated cold-rolled steel sheet is annealed.

Here, reasons why the component composition of the first embodiment is regulated will be described. Note that % means mass %.

C worsens core loss after strain relief annealing. A C content in the base steel sheet is set to 0.005% or less so that the phenomenon does not occur.

Si is an element effective to increase electric resistance and reduce core loss. When a Si content is less than 2%, the effect is not obtained. On the other hand, when the Si content is over 4%, a cold-rolling property greatly worsens. Therefore, the Si content in the base steel sheet is set to 2% to 4%.

Mn, similarly to Si, is an element effective to increase electric resistance. Further, Mn reacts with S in the steel to produce MnS, thereby rendering S harmless. To obtain these effects, a Mn content in the base steel sheet is preferably 0.1% or more. On the other hand, when the Mn content in the base steel sheet is over 1%, crystal grain growth during the annealing is hindered. Therefore, the Mn content in the base steel sheet is set to 1% or less.

Further, the Mn content in the non-oriented magnetic steel sheet becomes higher than the Mn content in the base steel sheet due to the formation of the Mn plating film. When the Mn content in the non-oriented magnetic steel sheet is over 10%, saturation flux density lowers to deteriorate a magnetic property. Therefore, the Mn content in the non-oriented magnetic steel sheet is preferably 10% or less.

Al, similarly to Si, is an element effective to increase electric resistance and reduce core loss. To obtain these effects, an Al content in the base steel sheet is preferably 0.1% or more, more preferably 0.5% or more. On the other hand, when the Al content is over 3%, castability of steel (molten steel) worsens. Therefore, the Al content in the base steel sheet is set to 3% or less.

V, similarly to Si, is an element effective to increase electric resistance and reduce core loss. However, when a V content is over 1%, the cold rolling of the annealed hot-rolled steel sheet is liable to become difficult. Therefore, the V content in the base steel sheet is preferably 1% or less. Further, the total content of Mn and V in the non-oriented magnetic steel sheet is preferably 11% or less.

P is an element having a remarkable effect to increase tensile strength, but does not need to be included in the first embodiment. When a P content is over 0.3%, great embrittlement is caused, and processing such as hot rolling and cold rolling on an industrial scale becomes difficult. Therefore, the P content in the base steel sheet is preferably 0.3% or less, more preferably 0.2% or less, and still more preferably 0.15% or less.

A S content is preferably as low as possible. Specifically, the S content in the base steel sheet is preferably 0.04% or less, more preferably 0.02% or less, and still more preferably 0.01% or less.

Cu has an effect of increasing strength within a range not giving an adverse effect to a magnetic property. Therefore, the base steel sheet may contain 5% Cu or less.

Nb delays the recrystallization of the steel sheet not only as inherent Nb but by the precipitation of mainly carbonitride of Nb in the steel sheet. Further, by the fine Nb precipitate, it also has an effect of increasing strength within a range not giving an adverse effect to the magnetic property. Therefore, the base steel sheet may contain 1% Nb or less.

N, similarly to C, worsens the magnetic property. Therefore, a N content in the base steel sheet is preferably 0.02% or less.

Most of other elements used in high-strength magnetic steel sheets to increase strength in related arts not only are considered as problematic because of cost for their addition but also give not a little adverse effect to the magnetic property, and thus there is no need to dare to make them contained. If they are dare to be contained, Ti, B, Ni, and/or Cr are used, for instance, in consideration of an effect of delaying the recrystallization, an effect of increasing strength, an increase in cost, and deterioration in magnetic property. In this case, their contents are preferably about as follows: Ti: 1% or less, B: 0.01% or less, Ni: 5% or less, and Cr: 15% or less.

Further, as for other trace elements, adding them because of generally-known various purposes in addition to their amount inevitably contained in an ore and/or scraps and so on does not impair the effect of the first embodiment at all. There are also elements that, in spite of their small amounts, form fine precipitates such as carbide, sulfide, nitride, and/or oxide and exhibit not a little effect of delaying the recrystallization. These fine precipitates also have a great adverse effect on the magnetic property, and if Cu or Nb is contained, Cu or Nb can provide a sufficient effect of delaying the recrystallization, and therefore, it is not necessary to dare to make these elements contained. Inevitable contents of these trace elements each are normally about 0.005% or less but may be about 0.01% or more for various purposes. In this case, it is also preferable that the total content of Mo, W, Sn, Sb, Mg, Ca, Ce, and Co is 0.5% or less in view of cost and the magnetic property.

Incidentally, the contents of these elements, except Mn, in the non-oriented magnetic steel sheet become slightly lower than their contents in the base steel sheet in accordance with the formation of the Mn plating film. However, since a thickness of the Mn plating film is far smaller than a thickness of the base steel sheet, the contents of the elements except Mn in the non-oriented magnetic steel sheet may be regarded as equal to their contents in the base steel sheet. On the other hand, the Mn content in the non-oriented magnetic steel sheet is set to 10% or less as described above. Then, when the Mn plating film with such a thickness that the Mn content in the non-oriented magnetic steel sheet becomes 10% or less is formed, Mn scarcely diffuses from the Mn plating film to the center of the base steel sheet. Therefore, the Mn content at the thickness center of the non-oriented magnetic steel sheet may be regarded as equal to its content in the base steel sheet.

Therefore, as the base steel sheet, usable is, for example, a cold-rolled steel sheet that contains C: 0.005% or less, Si: 2% to 4%, Mn: 1% or less (preferably 0.1% or more), and Al: 3% or less, with the balance being Fe and inevitable impurities. Alternatively, a cold-rolled steel sheet further containing 1% V or less may be used.

The thickness of the base steel sheet (cold-rolled steel sheet) is not particularly limited. It may be decided appropriately in consideration of a thickness of the non-oriented magnetic steel sheet as a final product and a rolling reduction in the rolling process. The thickness of the non-oriented magnetic steel sheet as the final product is not particularly limited either, but is preferably 0.1 mm to 0.3 mm in view of a reduction in high-frequency core loss.

A method for Mn-plating the base steel sheet is not limited to a specific method. Electroplating from an aqueous solution or a non-aqueous solvent, fused-salt electrolysis, hot dipping, vapor plating such as PVD (physical vapor deposition) and CVD (chemical vapor deposition), and so on are preferable because they can easily adjust a plating thickness (the thickness of the Mn plating film).

The thickness of the Mn plating film is not particularly limited, but is preferably large enough to sufficiently ensure a Mn amount diffused in the base steel sheet, and is preferably about 1 μm to 10 μm, for instance.

The annealing follows the Mn plating of the base steel sheet to diffuse Mn in the base steel sheet, thereby forming a Mn concentration gradient satisfying the above formula (1) or (2) (this will be described later). Annealing conditions (temperature, time, and so on) are not particularly limited, provided that Mn diffuses in the base steel sheet so that the above Mn concentration gradient is obtained. On the premise of batch annealing, the conditions are preferably "1000° C. or less and one hour or longer". The annealing conditions may be set on the premise of continuous annealing.

Next, reasons why the formulas (1) and (2) are defined in the first embodiment will be described.

Figure 1B:
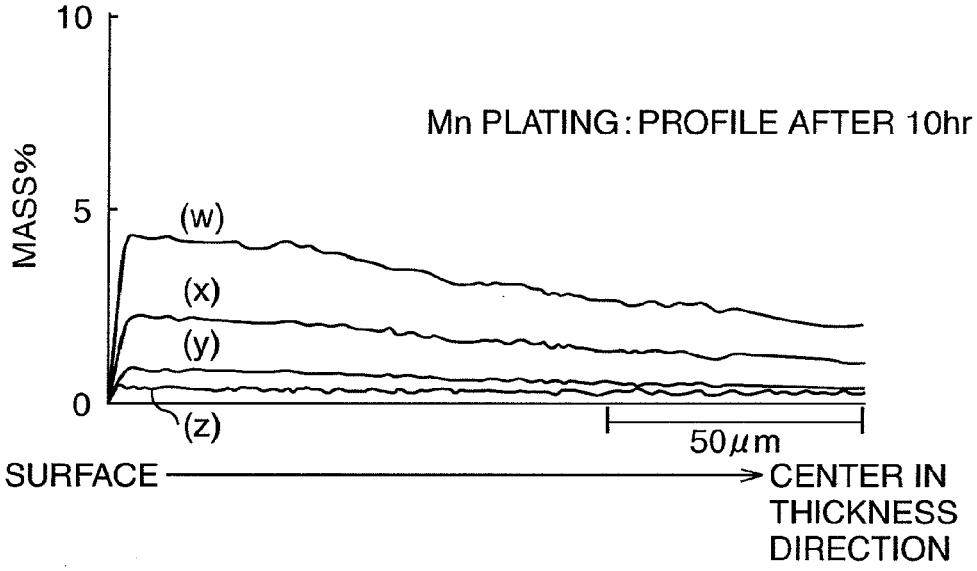
FIG. 1B is a chart showing correlations between a thickness of a Mn plating film and a distribution of a Mn concentration when 900° C. annealing is conducted for ten hours.
Figure 1C:
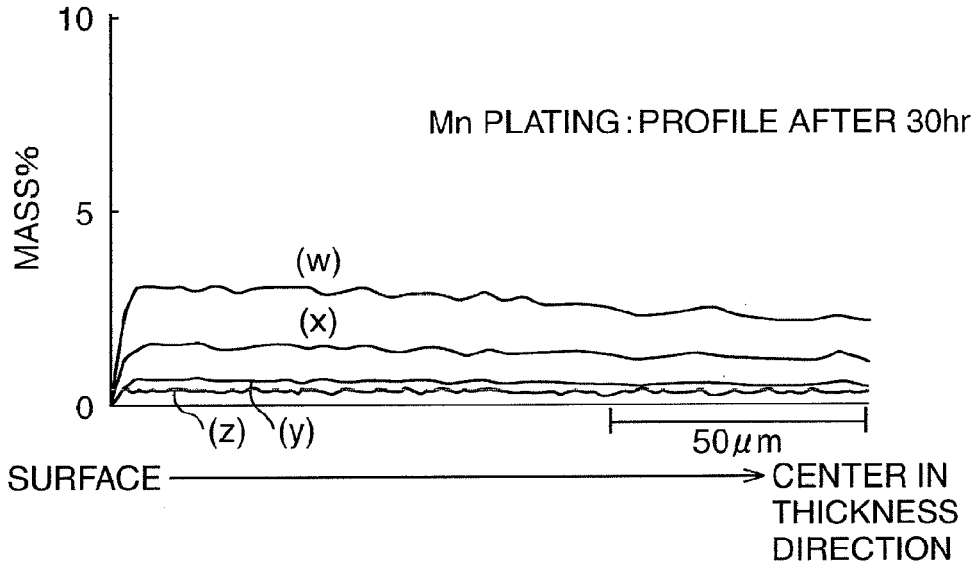
FIG. 1C is a chart showing correlations between a thickness of a Mn plating film and a distribution of a Mn concentration when 900° C. annealing is conducted for thirty hours.

FIG. 1A to FIG. 1C each show correlations between a thickness of a Mn plating film and a distribution of a Mn concentration in a thickness direction of a non-oriented magnetic steel sheet. In obtaining the correlations, cold-rolled steel sheets (base steel sheets) each containing C: 0.002%, Si: 3.0%, Mn: 0.3%, and Al: 0.6%, with the balance being Fe and inevitable impurities, were fabricated. Next, by a vapor deposition method, Mn plating films with a 2 μm thickness, a 5 μm thickness, and a 10 μm thickness were formed on surfaces of the respective cold-rolled steel sheets. Then, as a result of annealing, non-oriented magnetic steel sheets were obtained. A thickness of each of the cold-rolled steel sheets was 0.3 mm.

FIG. 1A shows a case where 900° C. annealing was conducted for three hours (hr), FIG. 1B shows a case where 900° C. annealing was conducted for ten hours, and FIG. 1C shows a case where 900° C. annealing was conducted for thirty hours. In FIG. 1A to FIG. 1C, (x) shows the distribution of the Mn concentration when the thickness of the Mn plating film was 5 μm, (y) shows the distribution of the Mn concentration when the thickness of the Mn plating film was 2 μm, and (w) shows the distribution of the Mn concentration when the thickness of the Mn plating film was 10 μm. Further, (z) shows the distribution of the Mn concentration when the Mn plating film was not formed and the annealing was conducted.

As shown in FIG. 1A to FIG. 1C, in each of the non-oriented magnetic steel sheets in which the Mn plating films were formed, the Mn concentration (mass %) got lower substantially linearly from the Mn concentration (mass %) at the surface or from the maximum Mn concentration (mass %) near the surface toward that at a center portion of the steel sheet.

The present inventors further measured core loss properties of these non-oriented magnetic steel sheets.

Figure 2:
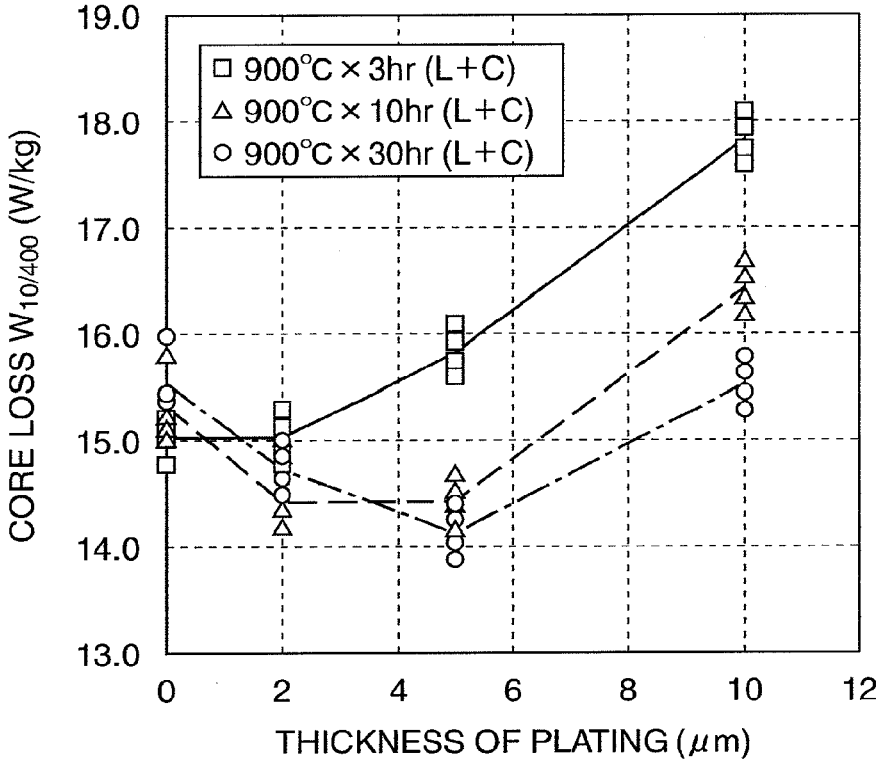
FIG. 2 is a chart showing correlations between a thickness of a Mn plating film and core loss $W_{10/400}$.

FIG. 2 shows correlations between the thickness of the Mn plating film and core loss $W_{10/400}$ (W/kg). Each value of the core loss $W_{10/400}$ in FIG. 2 is an average value (L+C) of a value of core loss $W_{10/400}$ (L) in an L direction (rolling direction) and a value of core loss $W_{10/400}$ (C) in a C direction (direction perpendicular to the rolling direction). It can be said from FIG. 2 that it is possible to reduce the core loss $W_{10/400}$ (W/kg) by appropriately selecting the thickness of the Mn plating film and the annealing time.

Figure 3:
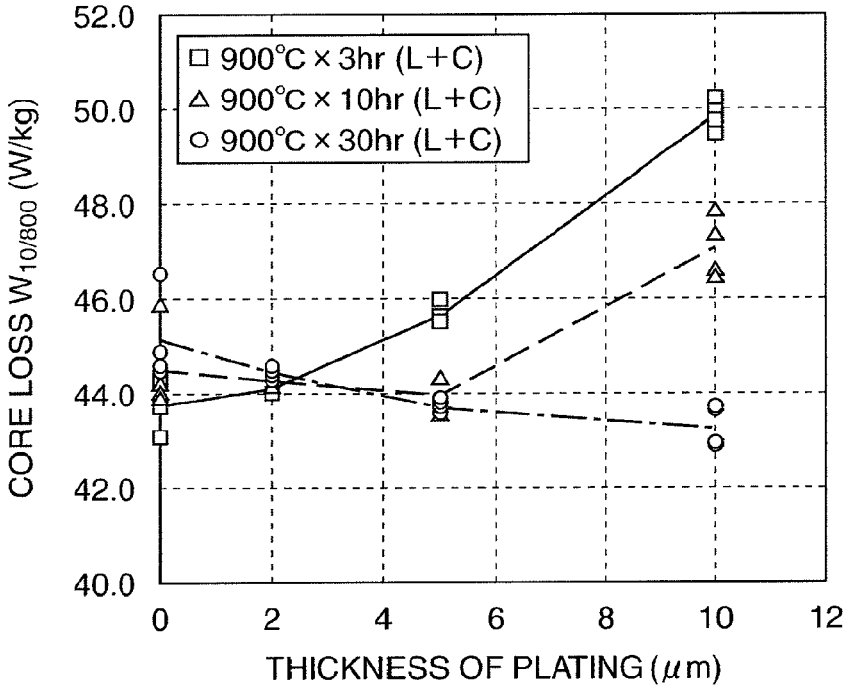
FIG. 3 is a chart showing correlations between a thickness of a Mn plating film and core loss $W_{10/800}$.
Figure 4:
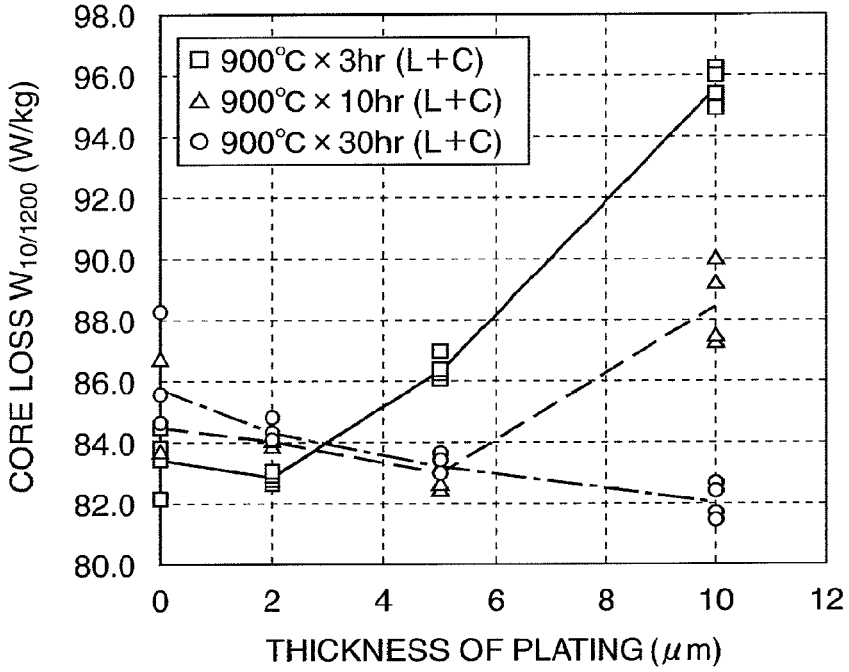
FIG. 4 is a chart showing correlations between a thickness of a Mn plating film and core loss $W_{10/1200}$.
Figure 5:
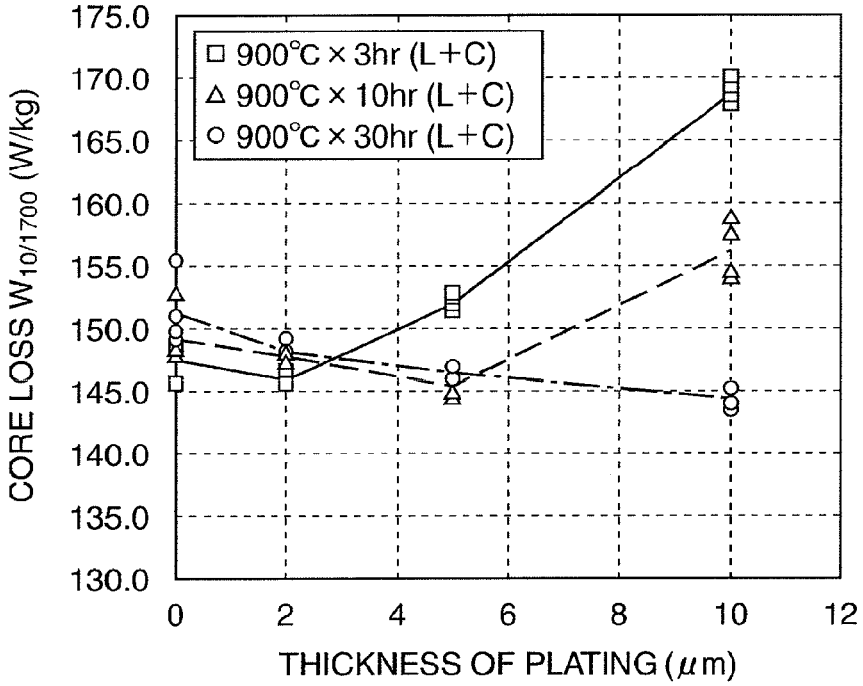
FIG. 5 is a chart showing correlations between a thickness of a Mn plating film and core loss $W_{10/1700}$.

FIG. 3 shows correlations between the thickness of the Mn-plating film and core loss $W_{10/800}$ (W/kg), FIG. 4 shows correlations between the thickness of the Mn plating film and core loss $W_{10/1200}$ (W/kg), and FIG. 5 shows correlations between the thickness of the Mn plating film and core loss $W_{10/1700}$ (W/kg). It is seen from FIG. 3 to FIG. 5 that when the 900° C. annealing was conducted for ten hours after the Mn plating film was formed on the cold-rolled steel sheet, a high-frequency core loss property improved, compared with the case where the Mn plating was not applied.

A possible reason why the core loss property in the high-frequency range thus improves may be because the Mn concentration in an area whose depth from the surface of the steel sheet is 50 μm increases due to the diffusion of Mn by the annealing as shown in FIG. 1, and the core loss property in this area improves.

The present inventors further studied a correlation between the distribution of the Mn concentration (mass %) after the annealing and the high-frequency core loss.

As a result, it has been found out that, in order to reduce the high-frequency core loss, it is important that the Mn concentration (mass %) in the thickness direction satisfies the following formula (1).

$$0.1<(Xs_{Mn}-Xc_{Mn})/t_{Mn}<100 \quad (1),$$

where $Xs_{Mn}$: the Mn concentration (mass %) at a surface of the steel sheet, $Xc_{Mn}$: the Mn concentration (mass %) at a center of the steel sheet, and $t_{Mn}$: a depth (mm), from the surface of the steel sheet, of a position where the Mn concentration (mass %) is equal to $Xc_{Mn}$.

When a value of $(Xs_{Mn}-Xc_{Mn})$ is 0.1 or less, Mn uniformly diffuses and is distributed substantially in the whole area in the steel sheet, so that the core loss in a surface layer portion of the steel sheet does not decrease. Therefore, the value of $(Xs_{Mn}-Xc_{Mn})/t_{Mn}$ is set to over 0.1 and preferably the value of $(Xs_{Mn}-Xc_{Mn})/t_{Mn}$ is over 0.5.

When the value of $(Xs_{Mn}-Xc_{Mn})/t_{Mn}$ is 100 or more, the gradient of the Mn concentration becomes steep in a narrow range, which greatly deteriorates a magnetic permeability at the time of excitation. Therefore, the value of $(Xs_{Mn}-Xc_{Mn})/t_{Mn}$ is set to less than 100.

Incidentally, $t_{Mn}$ is not particularly limited. It may be one including the surface layer portion (the area whose depth from the surface is about 50 μm) where eddy-current induced by a high frequency is generated.

In the above formula (1), the Mn concentration $(Xs_{Mn})$ at the surface of the steel sheet is used, but in the actual calculation of the distribution of the Mn concentration, the maximum Mn concentration $(Xs_{Mn}')$ near the surface of the steel sheet is sometimes used. Therefore, the following formula (2) may be used instead of the above formula (1). In this case, the region "near the surface of the steel sheet" is a region, in the magnetic steel sheet, starting from the uppermost layer portion of base steel present under an insulating film and ending at a point closer to the center portion of the steel sheet than the starting point by 5 μm.

$$0.1<(Xs_{Mn}'-Xc_{Mn})/t_{Mn}<100 \quad (2),$$

where $Xs_{Mn}'$: the maximum Mn concentration (mass %) near the surface of the steel sheet.

In the first embodiment, the above formulas (1) and (2) may be selectively used as necessary.

(Second Embodiment)

A non-oriented magnetic steel sheet according to a second embodiment of the present invention contains, by mass %: C: 0.005% or less; Si: 2% to 4%; Mn: 1% or less; V: 10% or less, and Al: 3% or less, with the balance being Fe and inevitable impurities, wherein a V concentration (mass %) in a thickness direction satisfies the following formula (3) or the following formula (4):

$$0.1<(Xs_V-Xc_V)/t_V<100 \quad (3)$$

$$0.1<(Xs_V'-Xc_V)/t_V<100 \quad (4),$$

where $Xs_V$: the V concentration (mass %) at a surface of the steel sheet, $Xs_V'$: the maximum V concentration (mass %) near the surface of the steel sheet, $Xc_V$: the V concentration (mass %) at a center of the steel sheet, and $t_V$: a depth (mm), from the surface of the steel sheet, of a position where the V concentration (mass %) is equal to $Xc_V$.

To produce the non-oriented magnetic steel sheet according to the second embodiment, V plating is applied on a surface of a base steel sheet with a predetermined component composition to form a V plating film, and thereafter V is diffused in the steel by annealing. During the annealing, recrystallization of the base steel sheet also occurs. As the base steel sheet that is to be V-plated, used is, for example, a cold-rolled steel sheet, similarly to the first embodiment. In this case, a V-plated cold-rolled steel sheet is obtained by the V plating, and thereafter, the V-plated cold-rolled steel sheet is annealed. Alternatively, an annealed hot-rolled steel sheet may be used as the base steel sheet. In this case, a V-plated hot-rolled steel sheet is obtained by the V plating, and thereafter a V-plated cold-rolled steel sheet is obtained by cold rolling of the V-plated hot-rolled steel sheet. Then, the V-plated cold-rolled steel sheet is annealed.

Here, reasons why the component composition of the second embodiment is regulated will be described. Note that % means mass %.

Contents of C, Si, Al, Mn, V, and so on in the base steel sheet are the same as those of the first embodiment.

The V content in the non-oriented magnetic steel sheet becomes higher than the V content in the base steel sheet due to the formation of the V plating film. When the V content in the non-oriented magnetic steel sheet is over 10%, saturation flux density lowers to deteriorate a magnetic property. Therefore, the V content in the non-oriented magnetic steel sheet is preferably 10% or less. Further, the total content of Mn and V in the non-oriented magnetic steel sheet is preferably 11% or less.

Incidentally, the contents of these elements, except V, in the non-oriented magnetic steel sheet become slightly lower than their contents in the base steel sheet in accordance with the formation of the V plating film. However, since a thickness of the V plating film is far smaller than a thickness of the base steel sheet, the contents of the elements except V in the non-oriented magnetic steel sheet may be regarded as equal to their contents in the base steel sheet. On the other hand, the V content in the non-oriented magnetic steel sheet is set to 10% or less as described above. Then, when the V plating film with such a thickness that the V content in the non-oriented magnetic steel sheet becomes 10% or less is formed, V scarcely diffuses from the V plating film to the center of the base steel sheet. Therefore, the V content at the thickness center of the non-oriented magnetic steel sheet may be regarded as equal to its content in the base steel sheet.

Further, as in the first embodiment, other elements, for example, Sn, Sb, B, and so on may be contained. Further, as the inevitable impurities, P, S, N, O, and so on may be contained.

Therefore, as the base steel sheet, usable is, for example, a cold-rolled steel sheet that contains C: 0.005% or less, Si: 2% to 4%, Mn: 1% or less (preferably 0.1% or more), and Al: 3% or less, with the balance being Fe and inevitable impurities. Alternatively, a cold-rolled steel sheet further containing 1% V or less may be used.

A method for V-plating the base steel sheet is not limited to a specific method. The same method as that of the first embodiment is adoptable.

The thickness of the V plating film is not particularly limited, but is preferably large enough to sufficiently ensure a V amount diffused in the base steel sheet, and is preferably about 1 μm to 10 μm, for instance.

The annealing follows the V plating of the base steel sheet to diffuse V in the base steel sheet, thereby forming a V concentration gradient satisfying the above formula (3) or (4) (this will be described later). Annealing conditions (temperature and time) are not particularly limited, provided that V diffuses in the base steel sheet so that the above V concentration gradient is obtained. On the premise of batch annealing, the conditions are preferably "1000° C. or less and one hour or longer" as in the first embodiment, but the annealing conditions may be set on the premise of continuous annealing.

Next, reasons why the formulas (3) and (4) are defined in the second embodiment will be described.

Figure 6A:
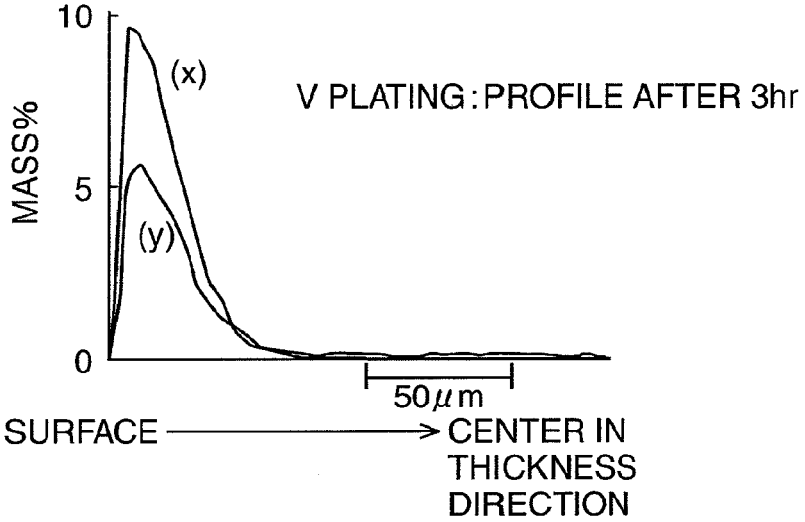
FIG. 6A is a chart showing correlations between a thickness of a V plating film and a distribution of a V concentration when 900° C. annealing is conducted for three hours.
Figure 6B:
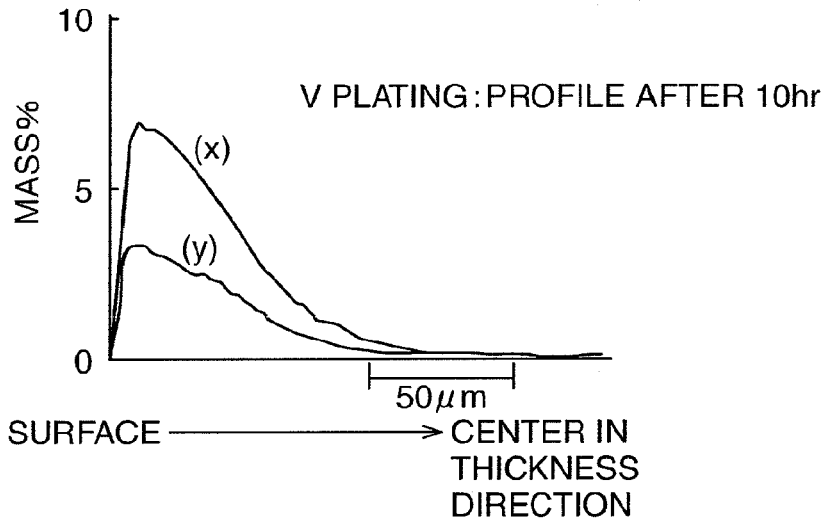
FIG. 6B is a chart showing correlations between a thickness of a V plating film and a distribution of a V concentration when 900° C. annealing is conducted for ten hours.
Figure 6C:
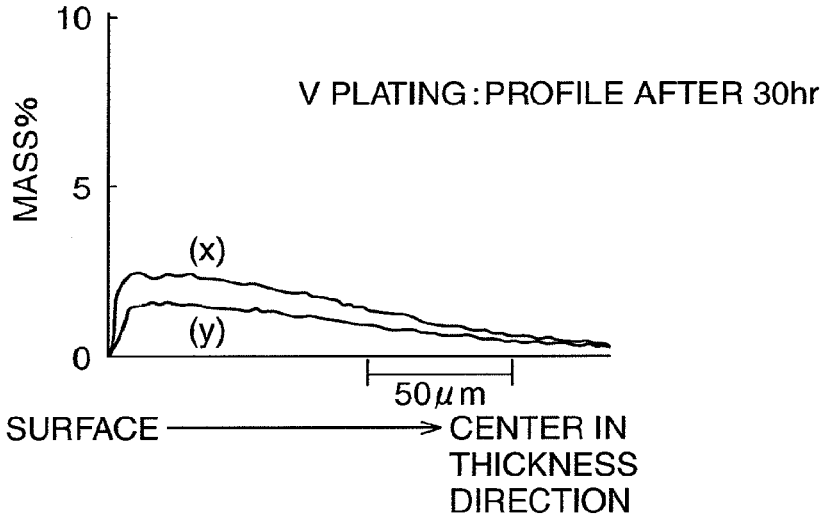
FIG. 6C is a chart showing correlations between a thickness of a V plating film and a distribution of a V concentration when 900° C. annealing is conducted for thirty hours.

FIG. 6A to FIG. 6C each show correlations between a thickness of a V plating film and a distribution of a V concentration in a thickness direction of a non-oriented magnetic steel sheet. In obtaining the correlations, cold-rolled steel sheets (base steel sheets) each containing C: 0.002%, Si: 3.0%, Mn: 0.3%, Al: 0.6%, and V: 0.01%, with the balance being Fe and inevitable impurities, were fabricated. Next, by a vapor deposition method, V plating films with a 1 μm thickness and a 5 μm thickness were formed on surfaces of the respective cold-rolled steel sheets. Then, after annealing, non-oriented magnetic steel sheets were obtained. A thickness of each of the cold-rolled steel sheets was 0.3 mm.

FIG. 6A shows a case where 900° C. annealing was conducted for three hours, FIG. 6B shows a case where 900° C. annealing was conducted for ten hours, and FIG. 6C shows a case where 900° C. annealing was conducted for thirty hours. In FIG. 6A to FIG. 6C, (x) shows the distribution of the V concentration when the thickness of the V plating film was 5 μm, and (y) shows the distribution of the V concentration when the thickness of the V plating film was 1 μm.

As shown in FIG. 6A to FIG. 6C, the V concentrations (mass %) each got lower substantially linearly from the V concentration (mass %) at the surface or from the maximum V concentration (mass %) near the surface toward that at a center portion of the steel sheet.

The present inventors further measured core loss properties of these non-oriented magnetic steel sheets.

Figure 7:
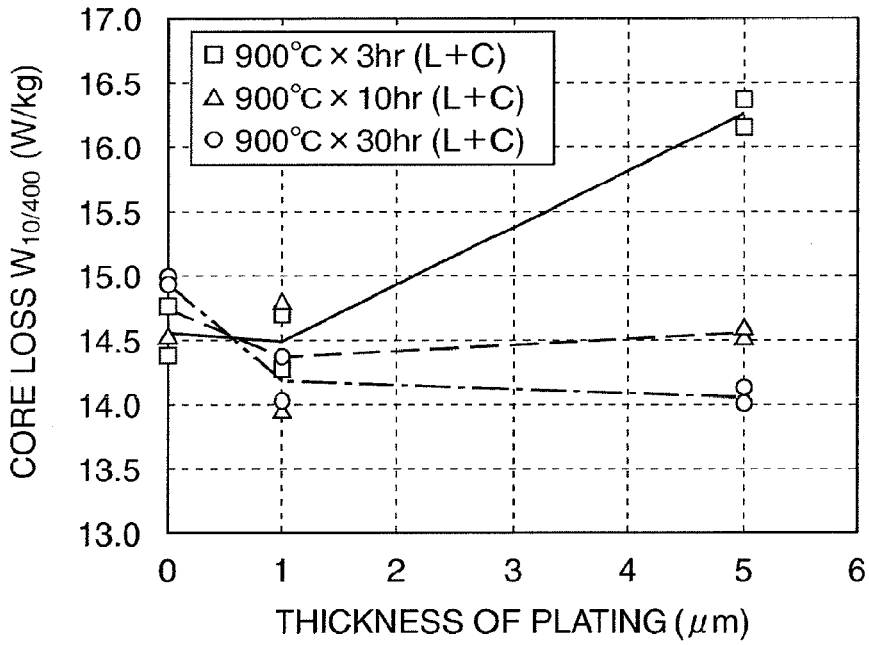
FIG. 7 is a chart showing correlations between a thickness of a V plating film and core loss $W_{10/400}$.

FIG. 7 shows correlations between the thickness of the V plating film and core loss $W_{10/400}$ (W/kg). Each value of the core loss $W_{10/400}$ in FIG. 7 is an average value (L+C) of a value of core loss $W_{10/400}$ (L) in an L direction (rolling direction) and a value of core loss $W_{10/400}$ (C) in a C direction (direction perpendicular to the rolling direction). It can be said from FIG. 7 that it is possible to reduce the core loss $W_{10/400}$ (W/kg) by appropriately selecting the thickness of the V plating film and the annealing time.

Figure 8:
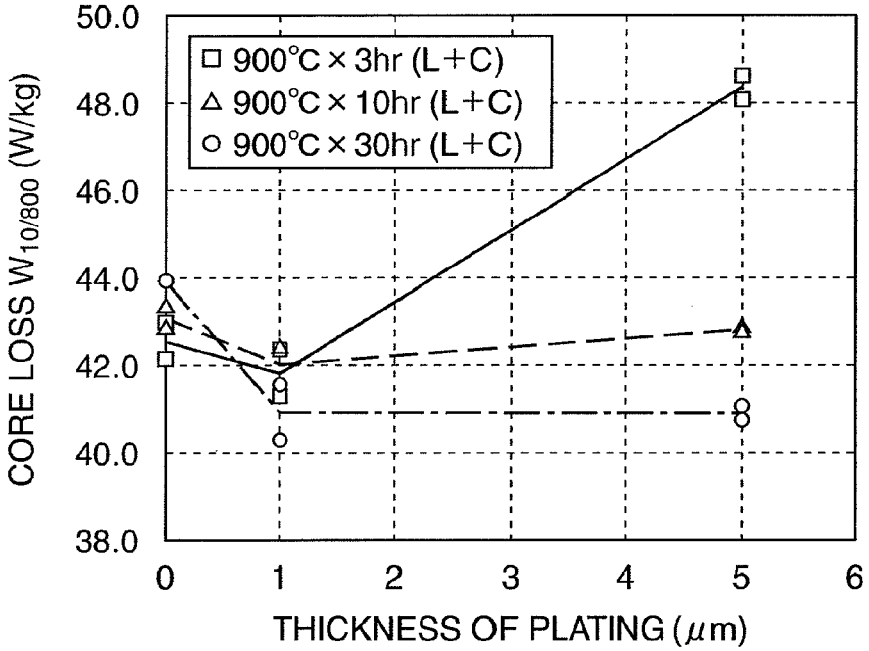
FIG. 8 is a chart showing correlations between a thickness of a V plating film and core loss $W_{10/800}$.
Figure 9:
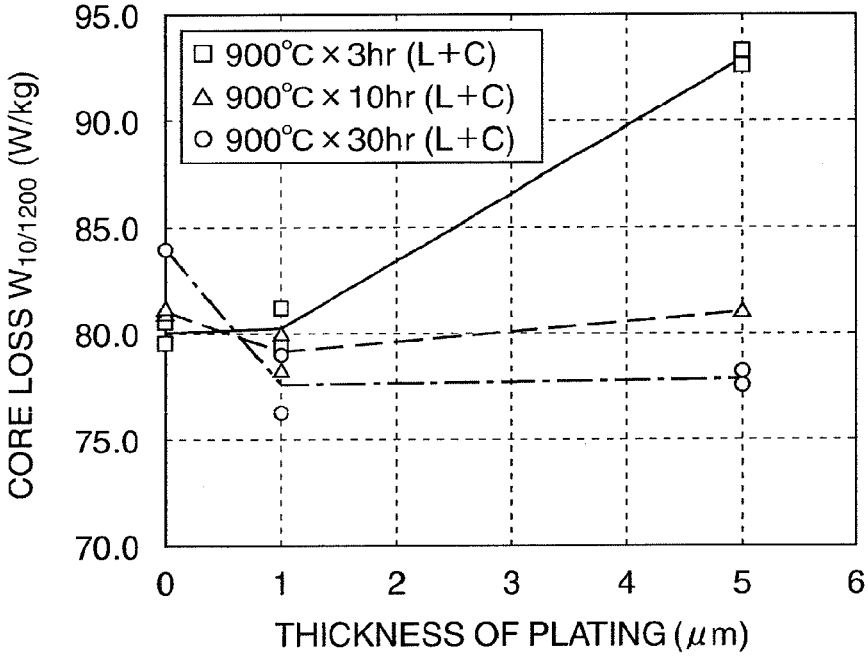
FIG. 9 is a chart showing correlations between a thickness of a V plating film and core loss $W_{10/1200}$.
Figure 10:
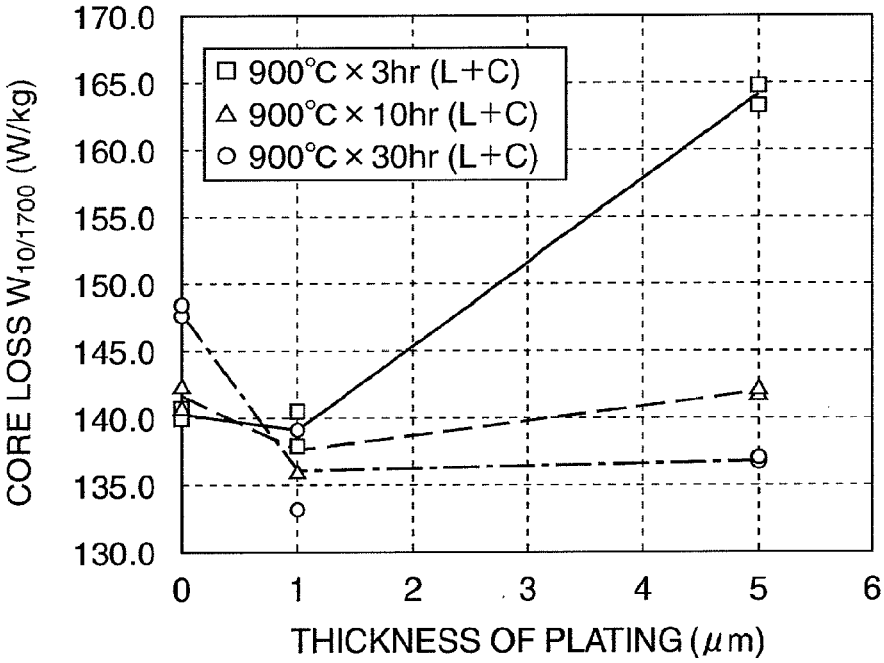
FIG. 10 is a chart showing correlations between a thickness of a V plating film and core loss $W_{10/1700}$.

FIG. 8 shows correlations between the thickness of the V-plating film and core loss $W_{10/800}$ (W/kg), FIG. 9 shows correlations between the thickness of the V plating film and core loss $W_{10/1200}$ (W/kg), and FIG. 10 shows correlations between the thickness of the V plating film and core loss $W_{10/1700}$ (W/kg). It is seen from FIG. 8 to FIG. 10 that when the 900° C. annealing was conducted for ten hours after the V plating film was formed on the cold-rolled steel sheet, a high-frequency core loss property improved, compared with the case where the V plating was not applied.

A possible reason why the core loss property in the high-frequency range thus improves may be because the V concentration in an area whose depth from the surface of the steel sheet is 50 μm increases due to the diffusion of V by the annealing as shown in FIG. 6, and the core loss property in this area improves.

The present inventors further studied a correlation between the distribution of the V concentration (mass %) after the annealing and the high-frequency core loss.

As a result, it has been found out that, in order to reduce the high-frequency core loss, it is important that the V concentration (mass %) in the thickness direction satisfies the following formula (3):

$$0.1<(Xs_V-Xc_V)/t_V<100 \quad (3),$$

where $Xs_V$: the V concentration (mass %) at a surface of the steel sheet, $Xc_V$: the V concentration (mass %) at a center of the steel sheet, and $t_V$: a depth (mm), from the surface of the steel sheet, of a position where the V concentration (mass %) is equal to $Xc_V$.

When a value of $(Xs_V-Xc_V)/tv$ is 0.1 or less, V uniformly diffuses and is distributed substantially in the whole area in the steel sheet, so that the core loss in a surface layer portion of the steel sheet does not decrease. Therefore, the value of $(Xs_V-Xc_V)/tv$ is set to over 0.1 and preferably, the value of $(Xs_V-Xc_V)/t_V$ is over 0.5.

When the value of $(Xs_V-Xc_V)/t_V$ is 100 or more, the gradient of the V concentration becomes steep in a narrow range, which greatly deteriorates a magnetic permeability at the time of excitation. Therefore, the value of $(Xs_V-Xc_V)/t_V$ is set to less than 100.

Incidentally, $t_V$ is not particularly limited. It may be one including the surface layer portion (the area whose depth from the surface is about 50 μm) where eddy-current induced by a high frequency is generated.

In the above formula (3), the V concentration ($Xs_V$) at surface of the steel sheet is used, but in the actual calculation of the distribution of the V concentration, the maximum V concentration ($Xs_V'$) near the surface of the steel sheet is sometimes used. Therefore, the following formula (4) may be used instead of the above formula (3). In this case, the region "near the surface of the steel sheet" is a region, in the magnetic steel sheet, starting from the uppermost layer portion of base steel present under an insulating film and ending at a point closer to the center portion of the steel sheet than the starting point by 5 μm.

$$0.1<(Xs_V'-Xc_V)/t_V<100 \quad (4)$$

where $Xs_V'$: the maximum V concentration (mass %) near the surface of the steel sheet.

In the second embodiment, the above formulas (3) and (4) may be selectively used as necessary.

Incidentally, the first embodiment and the second embodiment may be combined. For example, after the Mn plating film and the V plating film are both formed, the annealing may be conducted so that the formulas (1) to (4) are satisfied. Alternatively, after a plating film of the mixture of Mn and V is formed, the annealing may be conducted so that the formulas (1) to (4) are satisfied. That is, in non-oriented magnetic steel sheets produced by these methods, the following formula (5) or (6) is satisfied:

$$0.1<(Xs_{Mn,V}-Xc_{Mn,V})/t_{Mn,V}<100 \quad (5)$$

$$0.1<(Xs_{Mn,V}'-Xc_{Mn,V})/t_{Mn,V}<100 \quad (6),$$

where $Xs_{Mn,V}$: the sum of the Mn concentration (mass %) and the V concentration (mass %) at the surface of the steel sheet, $Xs_{Mn,V}'$: the maximum value of the sum of the Mn concentration (mass %) and the V concentration (mass %) near the surface of the steel sheet, $Xc_{Mn,V}$: the sum of the Mn concentration (mass %) and the V concentration at the center of the steel sheet, and $t_{Mn,V}$: a depth (mm), from the surface of the steel sheet, of a position where the sum of the Mn concentration (mass %) and the V concentration (mass %) is equal to $Xc_{Mn,V}$.

Next, various experiments actually conducted by the present inventors will be described. Conditions and so on in these experiments are examples adopted for confirming the feasibility and effect of the present invention, and the present invention is not limited to these examples. In the present invention, various conditions are adoptable within a range not departing from the spirit of the present invention and within a range achieving the object of the present invention.

(First Experiment)

First, hot-rolled steel sheets each containing, by mass %, C: 0.002%, Si: 3.0%, Mn: 0.2%, and Al: 0.6%, with the balance being Fe and inevitable impurities, were fabricated. A thickness of each of the hot-rolled steel sheets was 1.6 mm. Next, annealed hot-rolled steel sheets were obtained by 1050° C.

and one-minute annealing of the hot-rolled steel sheets. Thereafter, the annealed hot-rolled steel sheets were cold-rolled, whereby cold-rolled steel sheets (base steel sheets) with a 0.25 mm thickness were obtained. Subsequently, Mn plating films with various thicknesses (refer to Table 1) were formed on both surfaces of the cold-rolled steel sheets, thereby four kinds of samples were obtained. Further, a sample where no Mn plating film was formed was also fabricated. Thereafter, the samples were annealed at 900° C. for six hours, thereby non-oriented magnetic steel sheets were obtained. By this annealing, in the samples where the Mn plating films were formed, the diffusion of Mn from the Mn plating films to the base steel sheets and the recrystallization of the base steel sheets were caused to occur, and in the sample where no Mn plating film was formed, the recrystallization of the base steel sheet was caused to occur.

Then, magnetic properties (core loss $W_{101800}$) of the respective samples were measured with a single-plate magnetometer. Further, with an EPMA (electron probe micro analyzer), Mn concentrations in the thickness direction were measured by line analysis of steel sheet cross-sections perpendicular to the rolling direction (L direction). The results are shown in Table 1. In Table 1, a concentration gradient is a value of $(Xs_{Mn}-Xc_{Mn})/t_{Mn}$. Here, $Xc_{Mn}$ represents the Mn concentration at the center of the steel sheet (that is, the Mn content in the hot-rolled steel sheet).

TABLE 1

| | sample No. | thickness of Mn plating film (μm) | Mn concentration $Xs_{Mn}$ (%) | depth $t_{Mn}$ (mm) | concentration gradient | core loss $W_{10/800}$ (W/kg) |
|---|---|---|---|---|---|---|
| comparative example | 1 | — | 0.2 | — | — | 36.2 |
| example | 2 | 2 | 1.7 | 0.09 | 16.7 | 34.8 |
| | 3 | 4 | 2.8 | 0.08 | 32.5 | 33.9 |
| | 4 | 8 | 4.8 | 0.09 | 51.1 | 34.7 |
| comparative example | 5 | 20 | 10.2 | 0.09 | 111.1 | 37.8 |

As shown in Table 1, in the comparative example No. 1, the core loss in 800 Hz was high because the concentration gradient was 0.1 or less. In the comparative example No. 5, the core loss in 800 Hz was high because the concentration gradient was 100 or more. On the other hand, in the examples No. 2, No. 3, and No. 4, it was possible to obtain good core loss because the concentration gradient satisfied the formula (1). From the above, it is understood that the high-frequency core loss can be reduced if the Mn concentration gradient satisfies the formula (1).

(Second Experiment)

First, hot-rolled steel sheets each containing, by mass%, C: 0.002%, Si: 3.1%, Mn: 0.3%, Al: 0.8%, and V: 0.005%, with the balance being Fe and inevitable impurities, were fabricated. A thickness of each of the hot-rolled steel sheets was 2.0 mm Next, annealed hot-rolled steel sheets were obtained by 1000° C. and one-minute annealing of the hot-rolled steel sheets. Thereafter, the annealed hot-rolled steel sheets were cold-rolled, thereby cold-rolled steel sheets (base steel sheets) with a 0.30 mm thickness were obtained. Subsequently, V plating films with various thicknesses (refer to Table 2) were formed on both surfaces of the cold-rolled steel sheets, whereby three kinds of samples were obtained. Further, a sample where no V plating film was formed was also fabricated. Thereafter, the samples were annealed at 900° C. for five hours, thereby non-oriented magnetic steel sheets were obtained. By this annealing, in the samples where the V plating films were formed, the diffusion of V from the V plating films to the base steel sheets and the recrystallization of the base steel sheets were caused to occur, and in the sample where no V plating film was formed, the recrystallization of the base steel sheet was caused to occur.

Then, magnetic properties (core loss $W_{10/800}$) of the respective samples were measured with a single-plate magnetometer. Further, with an EPMA, V concentrations in the thickness direction were measured by line analysis of steel sheet cross-sections perpendicular to the rolling direction (L direction). The results are shown in Table 2. In Table 2, a concentration gradient is a value of $(Xs_v-Xc_v)/t_v$. Here, $Xc_v$ represents the V concentration at the center of the steel sheet (that is, the V content in the hot-rolled steel sheet.

TABLE 2

| | sample No. | thickness of V plating film (μm) | V concentration $Xs_V$ (%) | depth $t_V$ (mm) | concentration gradient | core loss $W_{10/800}$ (W/kg) |
|---|---|---|---|---|---|---|
| comparative example | 11 | — | 0 | — | — | 40.3 |
| example | 12 | 2 | 4.1 | 0.07 | 58.6 | 38.5 |
| | 13 | 4 | 7.8 | 0.08 | 97.5 | 39.5 |
| comparative example | 14 | 6 | 11.2 | 0.08 | 140.0 | 41.2 |

As shown in Table 2, in the comparative example No. 11, the core loss in 800 Hz was high because the concentration gradient was 0.1 or less. In the comparative example No. 14, the core loss in 800 Hz was high because the concentration gradient was 100 or more. On the other hand, in the examples No. 12 and No. 13, it was possible to obtain good core loss because the concentration gradient satisfied the formula (3). From the above, it is understood that the high-frequency core loss can be reduced if the V concentration gradient satisfies the formula (3).

Industrial Applicability

The present invention is usable in, for example, a magnetic steel sheet production industry and industries using magnetic steel sheets. The non-oriented magnetic steel sheet according to the present invention is usable as a material of cores (iron cores) of a motor and a transformer driven with a high-frequency range.

The invention claimed is:

1. A method for producing a non-oriented magnetic steel sheet comprising:

annealing a hot-rolled steel sheet containing, by mass %, C: 0.005% or less; Si: 2% to 4%; Mn: 1% or less; and Al: 3% or less, with the balance being Fe and inevitable impurities, so as to obtain an annealed hot-rolled steel sheet;

cold-rolling the annealed hot-rolled steel sheet so as to obtain a cold-rolled steel sheet;

plating a surface of the cold-rolled steel sheet with V so as to obtain a plated cold-rolled steel sheet; and subsequently annealing the plated cold-rolled steel sheet at a temperature between 900°C and 1000°C for one hour or more.

2. The method for producing a non-oriented magnetic steel sheet according to claim 1, wherein, by the annealing the plated cold-rolled steel sheet, a V concentration (mass %) in a thickness direction of the non-oriented magnetic steel sheet is made to satisfy the following formula:

$$0.1<(Xs_V-Xc_V)/t_V<100,$$

where $Xs_V$: the V concentration (mass %) at a surface of the steel sheet, $Xc_V$: the V concentration (mass %) at a center of the steel sheet, and $t_V$: a depth (mm), from the surface of the steel sheet, of a position where the V concentration (mass %) is equal to $Xc_V$.

3. The method for producing a non-oriented magnetic steel sheet according to claim 1, wherein, by the annealing the plated cold-rolled steel sheet, a V concentration (mass %) in a thickness direction of the non-oriented magnetic steel sheet is made to satisfy the following formula:

$$0.1<(Xs_V'-Xc_V)/t_V<100,$$

where $Xs_V'$: a maximum value of the V concentration (mass %) in a surface region, $Xc_V$: the V concentration (mass %) at a center of the steel sheet, and $t_V$: a depth (mm), from the surface of the steel sheet, of a position where the V concentration (mass %) is equal to $Xc_V$, and the surface region is a region with a thickness of 5 μm from the surface of the steel sheet.

4. The method for producing a non-oriented magnetic steel sheet according to claim 1, wherein a V concentration of the plated cold-rolled sheet is 0.34mass % or more.

5. A method for producing a non-oriented magnetic steel sheet comprising:

annealing a hot-rolled steel sheet containing, by mass %, C: 0.005% or less; Si: 2% to 4%; Mn: 1% or less; and Al: 3% or less, with the balance being Fe and inevitable impurities, so as to obtain an annealed hot-rolled steel sheet;

plating a surface of the annealed hot-rolled steel sheet with V so as to obtain a plated hot-rolled steel sheet;

cold-rolling the plated hot-rolled steel sheet so as to obtain a plated cold-rolled steel sheet; and subsequently annealing the plated cold-rolled steel sheet at a temperature between 900°C and 1000°C for one hour or more.

6. The method for producing a non-oriented magnetic steel sheet according to claim 5, wherein, by the annealing the plated cold-rolled steel sheet, a V concentration (mass %) in a thickness direction of the non-oriented magnetic steel sheet is made to satisfy the following formula:

$$0.1<(Xs_V-Xc_V)/t_V<100,$$

where $Xs_V$: the V concentration (mass %) at a surface of the steel sheet, $Xc_V$: the V concentration (mass %) at a center of the steel sheet, and $t_V$: a depth (mm), from the surface of the steel sheet, of a position where the V concentration (mass %) is equal to $Xc_V$.

7. The method for producing a non-oriented magnetic steel sheet according to claim 5, wherein, by the annealing of the plated cold-rolled steel sheet, a V concentration (mass %) in a thickness direction of the non-oriented magnetic steel sheet is made to satisfy the following formula:

$$0.1<(Xs_V'-Xc_V)/t_V<100,$$

where $Xs_V'$: a maximum value of the V concentration (mass %) in a surface region, $Xc_V$: the V concentration (mass %) at a center of the steel sheet, and $t_V$: a depth (mm), from the surface of the steel sheet, of a position where the V concentration (mass %) is equal to $Xc_V$, and the surface region is a region with a thickness of 5 μm from the surface of the steel sheet.

8. The method for producing a non-oriented magnetic steel sheet according to claim 5, wherein a V concentration of the plated cold-rolled sheet is 0.34mass % or more.

* * * * *